US005632689A

United States Patent [19]

Duca

[11] Patent Number: 5,632,689

[45] Date of Patent: May 27, 1997

[54] GOLF TRAINING APPARATUS AND METHOD

[75] Inventor: Joe Duca, Canon City, Colo.

[73] Assignee: Golf Training Technologies, Inc., Denver, Colo.

[21] Appl. No.: 525,930

[22] Filed: Sep. 7, 1995

[51] Int. Cl.[6] ..... A63B 69/36

[52] U.S. Cl. ..... 473/279

[58] Field of Search ..... 473/278, 279, 473/257

[56] References Cited

U.S. PATENT DOCUMENTS

| | | | |
|---|---|---|---|
| 2,879,996 | 3/1959 | Lederer | 273/35 |
| 2,934,348 | 4/1960 | Magida | 473/257 X |
| 2,937,875 | 5/1960 | Mason et al. | 273/195 |
| 3,413,006 | 11/1968 | Beston | 273/187 |
| 3,522,947 | 8/1970 | Anderson et al. | 273/176 |
| 3,542,369 | 11/1970 | Anderson | 473/278 X |
| 3,595,581 | 7/1971 | Anderson et al. | 273/176 H |
| 3,633,918 | 1/1972 | Smiley et al. | 273/195 B |
| 3,639,923 | 2/1972 | Stewart | 273/187 R |
| 3,693,979 | 9/1972 | Koett | 473/279 |
| 4,875,684 | 10/1989 | Benilan | 273/195 B |
| 5,005,837 | 4/1991 | Martinez | 273/195 B |
| 5,133,557 | 7/1992 | Sugimoto | 273/201 |

*Primary Examiner*—William H. Grieb
*Attorney, Agent, or Firm*—Sheridan Ross P.C.

[57] ABSTRACT

An apparatus and method are provided for teaching golfers how to adjust their body position relative to a golf ball depending upon their frame of reference to an intended target, in order to drive the golf ball toward the intended target.

22 Claims, 5 Drawing Sheets

GOLF TRAINING APPARATUS AND METHOD

FIELD OF THE INVENTION

The present invention relates to an apparatus and method for teaching golfers how to adjust their body position relative to a golf ball depending upon their frame of reference to an intended target in order to drive the golf ball toward the intended target.

BACKGROUND OF THE INVENTION

The game of golf has become increasingly popular as a recreation throughout the world. In order to become proficient in the game of golf, it is important for a player to learn how to consistently drive their ball from a variety of different lies toward an intended target, such as the pin.

Despite the existence of numerous golf teaching devices, many golfers are unable to consistently drive golf balls toward their intended targets. In this regard, it has been found that a golfer's inaccuracy increases when the golfer's line of sight to the target is not parallel with the fairway, cart paths, contiguous hazards (e.g. treelines, waterways, etc.) and other similar golf course features that establish a frame of reference relative to a target depending upon the particular lie of the golf ball.

SUMMARY OF THE INVENTION

It is well-established that the body position of a golfer when addressing the ball affects the golfer's swing and thus the trajectory of the ball when driven. The present inventors have recognized that the frame of reference from which a golfer views a target can markedly effect the positioning of many golfers with respect to the ball, resulting in inconsistent and unpredictable ball trajectories. For example, when a right-handed golfer must make a shot diagonally across a fairway, it has been observed that the golfer tends to unknowingly move in on the ball or move away from the ball, causing the ball to deviate to the right, or to the left, respectively, from the straight line between the ball and the intended target.

Accordingly, it is an object of the present invention to provide an apparatus and method for aiding golfers in learning how to drive a golf ball from a variety of different lies toward an intended target.

More particularly, it is an object of the present invention to provide an apparatus and method for teaching golfers how to adjust their frame of reference relative to an intended target in order to drive a golf ball toward the intended target.

It is a further object of the present invention to provide a method and apparatus for teaching golfers how to maintain consistent body position relative to a golf ball when driving the golf ball in a variety of different lies toward an intended target.

In accordance with the present invention, an apparatus for training golfers is provided which includes a base assembly and a platform rotatably supported by the base assembly from which a golfer can drive a golf ball. Disposed on the platform are golfer positioning means for determining the position of a golfer relative to a golf ball on the platform. Also disposed on the platform are target alignment means for aligning the platform with respect to a desired target.

The golfer positioning means for determining the position of a golfer relative to a golf ball on the platform include one or more markings integral with, or placed or painted on the top surface of the platform which delineate separate areas in which a golf ball can be placed, and one or more markings integral with, or placed or painted on the platform to delineate different areas on the platform where a golfer must stand in order to address a golf ball. Alternatively, or in addition to the golf ball position markings, the platform can contain one or more areas designed for allowing the placement of a tee on the platform, or which includes a stationary tee made of rubber or other resilient material capable of withstanding repeated contact with the head of a golf club.

The function of the golf ball position markings and tee areas is to provide the golfer with a reference, preferably a visual reference, for consistently placing balls on the platform in the same spot for a plurality of drives. Similarly, the function of the markings on the platform where a golfer must stand in order to address a golf ball is to provide the golfer with a reference, preferably a visual reference, for locating and recalling the position of the golfer's feet, and therefore body position on the platform, from drive to drive. Together, the ball position markings and the golfer body position markings provide the golfer with a reference of body position relative to a golf ball on the platform.

Advantageously, the ball position markings on the platform can include a series of symbols which define a row or line that is substantially parallel with the straight line between the golf ball and the target, such as when the platform is aligned, as described below, with respect to a desired target. Further, it is desirable that the markings for referencing a golfer's body position are a series of symbols and/or solid lines which define a grid comprising one or more columns and rows, wherein at least one of such columns or rows of symbols is also substantially parallel with the straight line between the golf ball and the desired target, and at least one of the other of such columns or rows of symbols is perpendicular to the straight line between the golf ball and the desired target, such as when the platform is aligned with respect to a desired target. When arranged in such a manner, the symbols, such as polygons, circles and lines, can be used by the golfer to visually align his or her feet relative to the ball, and relative to the straight line to the target when the platform is aligned with respect to a desired target. In this regard, it is noted that the means for determining the position of a golfer relative to a golf ball on the platform can also serve as a frame of reference for the golfer's body position relative to the desired target.

Although the markings for the golf ball and the golfer's feet can be made simply and economically by painting lines on the platform, other, more expensive means for accomplishing the function of these markings, however, such as electronic sensing apparatus and the like are contemplated by the inventors and are within the scope of the present invention.

The target alignment means of the golf training apparatus include one or more markings or symbols disposed on the platform that form one or more lines that can be utilized to visually align the golf ball position markings and/or golfer body position markings on the platform in a substantially parallel orientation relative to the straight line between a ball on the platform and a desired target or relative to the desired flight path of the ball toward the target, i.e. to align the platform with respect to a desired target. In this regard, the golf ball position markings and/or the golfer body position markings can be used as the target alignment means. Advantageously, however, the target alignment means includes a separate set of markings integral with, or placed or painted on the top surface of the platform.

As a substitute for, or in addition to such markings, the target alignment means can also include one or more apparatus disposed on the platform, such as a substantially straight edge of the platform, for use by the operator in visually aligning the platform with respect to a desired target. Advantageously, however, such apparatus extend from the platform toward the intended target for aid in visually aligning the platform with a desired target, as previously described. Such apparatus include, but are not limited to, one or more rods extending from the platform, or other optical sighting device, such as a laser assembly having a beam that can be extended from the platform toward a desired target.

Platforms suitable for use in the present invention must be of sufficient size and strength to accommodate and support the weight of at least one golfer, and be capable of withstanding the forces exerted by a golfer when hitting or "driving" a ball off the platform. Accordingly, the platform can be constructed of wood, construction grade plastic, fiberglass, a suitable metal such as steel or iron, or composite materials, and can be fabricated in any desired geometrical shape, including, but not limited to, circles, ovals and polygons. In general, the platform is substantially planar on both its upper and lower surfaces, although planarity of such surfaces is not required. In addition, the platform can contain a padded mat of elastomeric or fibrous material for the golfer to stand on to simulate play on a natural, grass fairway. Such materials include known natural or synthetic turf simulating materials and indoor/outdoor carpeting materials. Advantageously, the portion of the platform from which golf balls will be hit contains a mat comprised of a synthetic turf material having high wear characteristics, and the portion of the platform where a golfer must stand to address a golf ball on the platform contains a mat comprised of a synthetic turf material capable of withstanding repeated contact with spiked golf shoes. For the purposes of the preceding and following discussion, the term "platform", as used herein, refers to either, or both, the platform and the platform mat.

The platform is supported by a base assembly, and is rotatably connected thereto. The base assembly is comprised of a frame, fabricated from a material of sufficient strength and rigidity to withstand the forces generated by a golfer when driving a golf ball off the platform. Such suitable materials include, but are not limited to, metals such as iron or steel, wood, construction grade plastics, fiberglass and composite materials. The base assembly also contains a plurality of bearings mounted on the frame which contact the bottom surface of the platform for supporting the platform, and allow the platform to rotate relative to the base assembly. Advantageously, the bottom surface of the platform contains a hard, bearing surface to prevent wear of the bottom surface of the platform in contact with the bearings. Bearings suitable for such use include, but are not limited to, slide bearings, ball bearings, and cylindrical roller bearings, such as casters. When the golf training apparatus is in use, the frame is in contact with the ground and is substantially stationary while the golfer drives balls off the platform and rotates the platform to different positions.

Although not required, the base assembly can also include a drive assembly mounted on the frame for changing the position of the platform relative to the base assembly, and to allow a golfer to align the platform with a number of different targets, as previously described. The drive assembly can include a motor and a geared drive system. Advantageously, the drive assembly can include an electric motor which is capable of being operated on either alternating or direct current, as described in more detail below. The motor should be of suitable horsepower to change the position of the platform relative to the base while one or more golfers are standing on the platform.

The motor can be rotatably connected to the platform through the use of the geared drive system, which can include a motor drive shaft, a platform shaft and a plurality of gears in mesh with one another. Preferably, the gear drive system contains suitable gear reduction to allow control over the speed of rotation of the platform. When the motor is actuated, the geared drive assembly is energized through the motor drive shaft and the position of the platform can be adjusted relative to the base assembly, such as by rotating the platform on the axis of the platform shaft. When the motor is turned off, the position of the platform can be maintained as a result of the internal resistance of the motor to movement of the drive shaft. Accordingly, the motor also serves to lock the platform into a desired position, to prevent rotation or swaying of the platform when a golfer on the platform swings to hit a ball.

If the base assembly includes an electric motor as described, it is desirable that the base assembly also include a battery pack mounted on the frame and electrically connected to the motor for operating the drive assembly on direct current rather than alternating current. When the golf training apparatus is in use, the operator can advantageously choose whether to operate the drive assembly using alternating current, if an alternating current source is available, or using direct current when operation with alternating current is not feasible. In this regard, the base assembly also includes a battery charger mounted on the frame and electrically connected to the battery for recharging the battery from an alternating current source. The battery charger thus also contains electrical connections for tapping into an alternating current source. If the motor being used in the drive assembly requires 12 volt direct current, known 12 volt batteries and chargers, such as car batteries and car battery chargers are suitable for use in the present invention.

For adjusting the position of the platform relative to the base assembly using the drive assembly, and for aligning the platform with different targets, the base assembly also includes at least one controller. When an electric motor is utilized in the drive assembly, suitable controllers include, but are not limited to, electrical switch devices electrically connected to the motor, such as toggle switches or button-type switches. If the golf training apparatus is to be used at a driving range, country club or similar facility, a coin or token operated controller can be mounted to the frame of the base assembly such that money can be collected from golfers in return for the use of the golf training device for a selected period of time. Alternatively, the controller can be operated remotely by the use of a hard-wired remote, which is especially useful if a golf training professional is supervising the use of the golf training device.

In accordance with the present invention, a method is also provided for teaching golfers to maintain consistent body positioning with respect to a golf ball and a target under different frames of reference. Such method includes the steps of aligning a platform having means for determining the position of a golfer relative to a golf ball with respect to a first target, having the golfer hit a ball from the platform until the golfer obtains a position from which he or she can consistently hit the ball acceptably close to the target, and changing the position of the platform to a second position where it is aligned with respect to a second target, and having the golfer hit at least one golf ball from the platform in the second position. Advantageously, the position of the golfer with respect to the ball when the platform is in a first position should be noted, so that it can be compared with the position of the golfer when hitting from or standing on the platform in a second position. As a result of the comparisons in body positions relative to the ball, the golfer can appreciate that when a golfer's frame of reference changes, the golfer has a tendency to change body position with respect to the golf ball, which causes the golfer's shot to deviate from the intended path toward the target. Though desirable, it is not necessary that the method of the present invention be used solely in conjunction with the golf training apparatus described herein.

DETAILED DESCRIPTION

The golf training apparatus of the present invention includes a platform for supporting at least one golfer which is capable of being rotated relative to a fixed base assembly. The platform includes markings for allowing a golfer using the apparatus to determine their body position relative to the golf ball, and can also include other features for aligning the platform with respect to a desired target.

A detailed description of an embodiment of the present invention for use by right-handed golfers will now be given with reference to the Figures. Although this description is provided in relation to a golf training device to be used by right-handed golfers, a mirror image of the described design can be used to accommodate left-handed golfers. In addition, it is contemplated that a right-handed golf training device can be rotated 180 degrees to accommodate use by left handed golfers.

Figure 1:
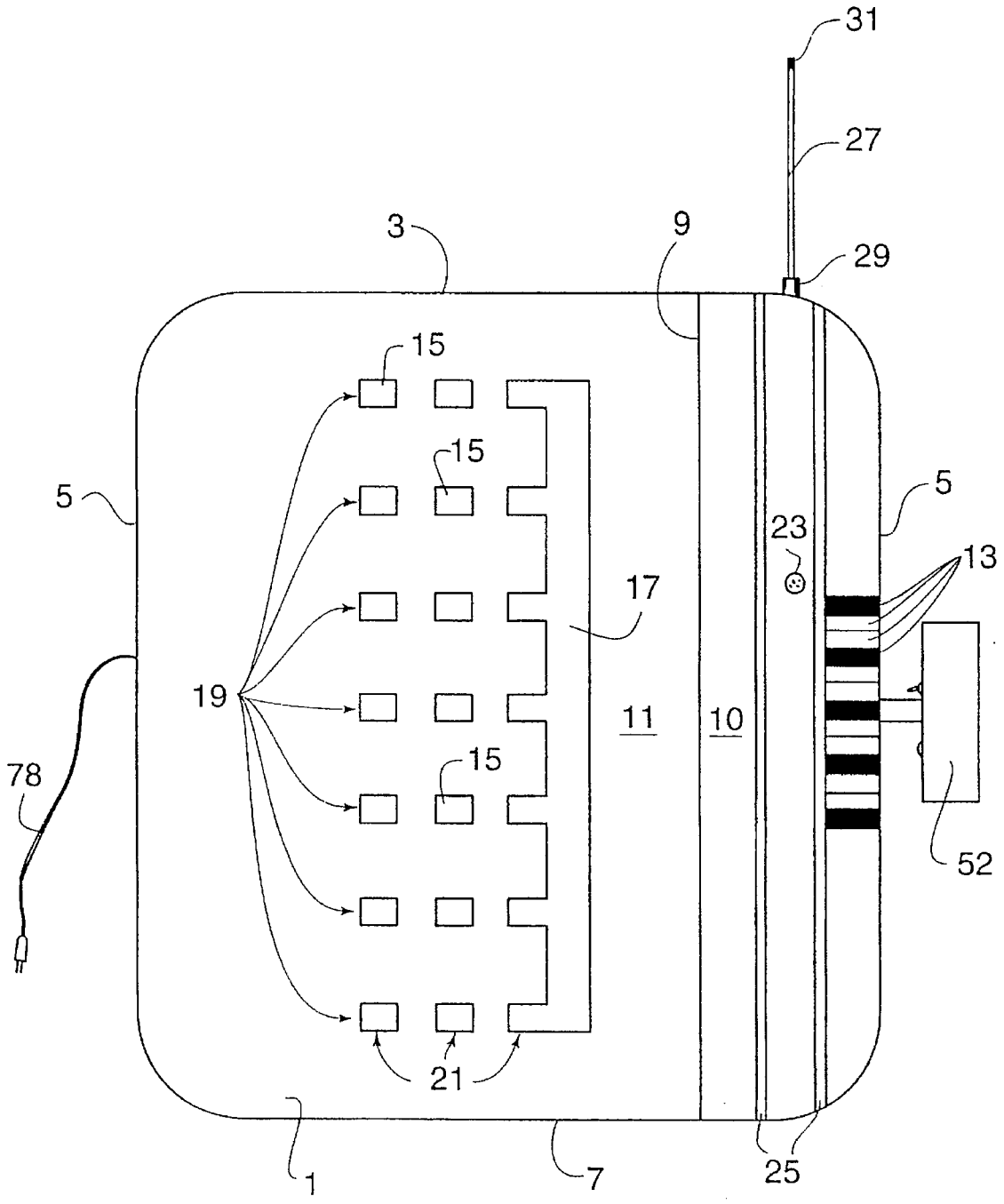
FIG. 1 is a plan view of one embodiment of the golf training device of the present invention.

As can be been seen in the plan view of FIG. 1, the golf training device of the present invention includes a generally square, fiberglass platform 1 with rounded corners, having a front 3, two sides 5 and a back 7, for supporting at least one golfer. The top, substantially planar surface of the platform 1 (shown) is covered by a platform mat having two portions divided along line 9; a first portion 10 where a golf ball can be placed to be hit by a golfer, and a second portion 11 where the golfer must stand in order to address a ball placed in the first portion 10 of the platform mat. The first portion 10 of the mat is made of a synthetic fibrous material having high wear characteristics, that is sold under the trademark "FIBER-LOK" by Burnham Products, Inc in Wichita, Kans. The second portion 11 of the mat is also made of a synthetic fibrous material sold under the trademark "ASTROTURF" by Southwest Recreational Industries in Leander, Tex. Underlying the second portion 11 of the platform mat is an elastomeric pad (not shown) for simulating the feel of a natural, grass fairway.

Integral with the first portion 10 of the platform mat and forming a row from back to front of the platform are several contrastingly colored, rectangular ball position markings 13, made of differently colored fibers, which provide a visual reference for consistent ball positioning on the platform by the golfer from shot to shot. The second portion of the platform mat 11 contains numerous rectangular foot placement markings 15, and foot placement line 17 painted on the mat, which provide a visual reference for consistent body positioning of the golfer with respect to the ball on each drive. The foot placement markings 15 and foot placement line 17 are aligned in seven columns 19 and three rows 21. The ball position markings 13 are arranged in a row that is opposite from and substantially parallel to the three rows 21 defined by foot placement markings 15 and foot placement line 17, and substantially perpendicular to the seven columns 19 defined by foot placement markings 15 and foot placement line 17. In this relationship, ball position markings 13 can be used by the golfer to position the ball in various positions in the golfer's stance, as is typically desired when practicing with different golf clubs, e.g. different numbered irons and woods.

The first portion 10 of the platform mat also contains a tee placement area 23 for holding a tee and the ball when the golfer desires to hit a golf ball from a teed position. Yet further, the first portion be of the platform mat contains two integral, parallel lines 25 made up of colored fibers for use in visually aligning the golf ball position markings 13 and three rows 21 of foot placement markings 15 and foot placement line 17 in a substantially parallel orientation relative to the straight line between a ball on the first portion 10 of the platform and an intended target or relative to the desired flight path of the ball toward the target, i.e. aligning the platform with respect to a desired target. Further in this regard, the platform 1 contains a steel rod member 27 which can be extended from a reservoir tube 29 which is mounted on the bottom surface of the platform 1. The end 31 of the rod 27 is painted a highly visible color to aid the user of the golf training device in visually aligning the platform with respect to a desired target.

Figure 2:
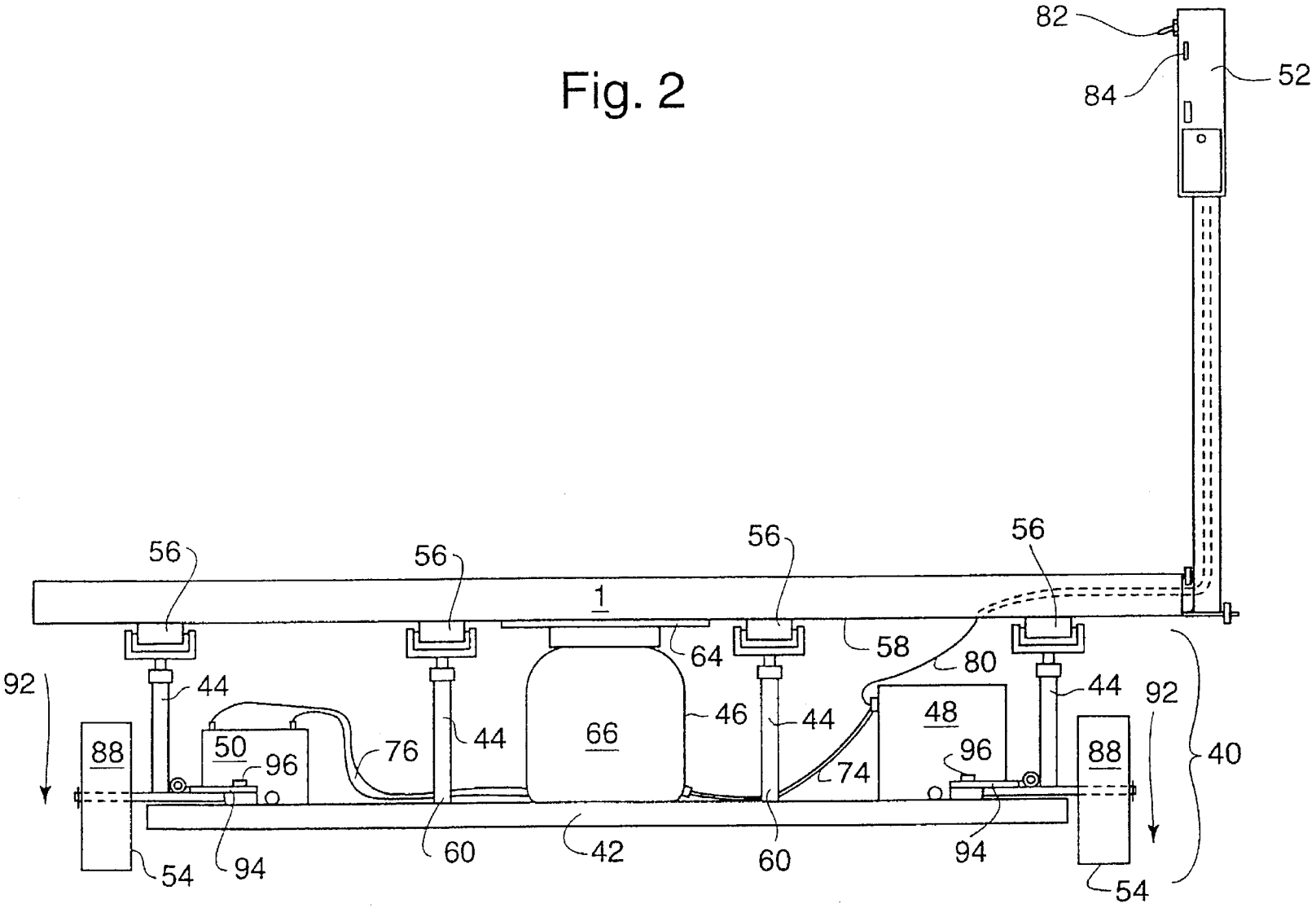
FIG. 2 is an inward, back view of one embodiment of the golf training device of the present invention.

FIG. 2 is a back, inward view of the golf training device of the present invention. In FIG. 2, it can be seen that the platform 1 is rotatably mounted on a base assembly 40 which includes a steel frame 42 containing a number of bearings 44 for rotatably supporting the platform 1, a drive assembly 46, a battery pack 48, a battery charger 50, a controller 52, and wheel assemblies 54, all of which will be described in more detail below.

Figure 3:
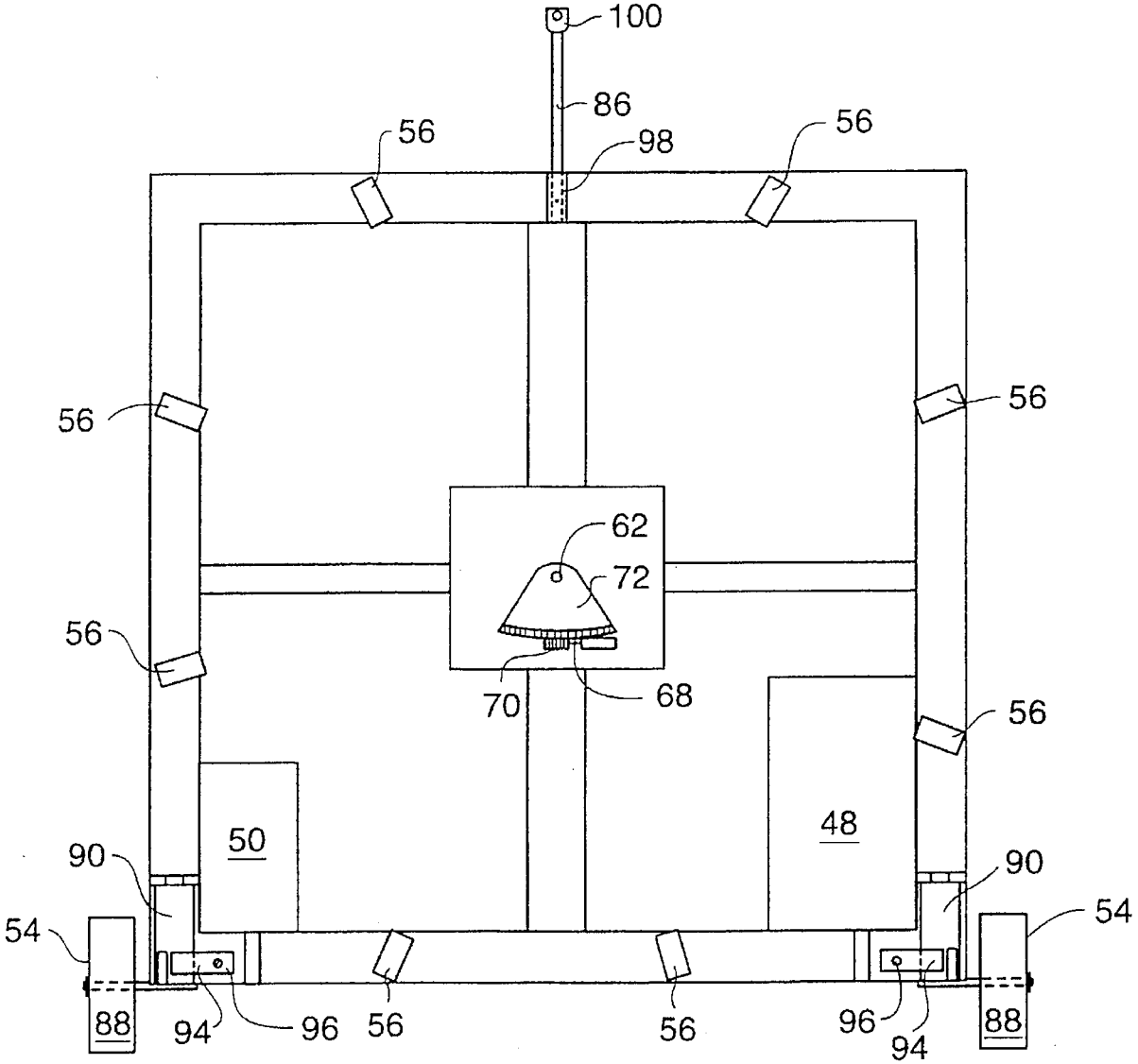
FIG. 3 is a plan view of the base assembly of one embodiment of the golf training device of the present invention with the platform removed.

As shown in FIG. 3, which is a plan view of the base assembly 40 with the platform 1 removed, and FIG. 2, the bearings 44 contain cylindrical rollers 56 in contact with the bottom surface 58 of the platform 1 and have one end 60 welded to the frame 42. The bearings 44 are arranged in a circular orientation on the frame 42 and rotatably support the platform 1 while allowing rotation of the platform 1 with respect to the base assembly 40. As shown FIGS. 2 and 3, the platform 1 is rotatably connected to the drive assembly 46 by use of a platform shaft 62 affixed to a plate 64 which is mounted on the bottom surface of the platform 1. The platform shaft 62 has a vertical axis of rotation. The drive assembly 46 also includes an electric motor 66 with a drive shaft 68 having a horizontal axis of rotation. The drive shaft contains a worm gear 70 which meshes with another, horizontally positioned gear 72 mounted on the vertical platform shaft 62 in order to rotate the platform 1 relative to the frame 42. The geared drive assembly 46 also includes a gear reduction mechanism to control the speed of rotation of the platform. Suitable electric motors and geared drive systems, as shown, are 12 volt satellite dish positioning motor and gear drive systems, which can be obtained from Ajak Company in Florence, Colo. Such motors are designed to be operated on either alternating or direct current depending upon the desire of the operator. In addition, the gear drive includes stops on the platform shaft gear 72 face which prevent the platform drive shaft from rotating greater than 180 degrees.

The frame 42 also supports a 12 volt car battery 48 which is electrically connected 74 to the electric motor 66 for use in driving the motor 66 on direct current. The battery 48 can be recharged by the 12 volt charger 50 which is also mounted on the frame 42, when the golf training device is not in use. The charger 50 is thus electrically connected 76 to the battery 48 and contains an electrical cord 78 (shown in FIG. 1) for tapping into an alternating current source for use in charging the battery 48 or for operating the drive assembly 46 using alternating current.

The golf training device can be operated by use of a controller 52 mounted on and extending upward from the frame 42. The controller 52 is electrically connected 80 to the battery 48 and drive assembly 46, and contains a simple three position (forward-off-reverse) toggle electric switch 82 for energizing the drive assembly 46 and changing the angular position of the platform 1 with respect to the frame 42. The controller 52 is designed to be actuated for a specific period of time by the insertion of coins or tokens into the receiving slot 84.

As stated previously, the frame also includes retractable wheel assemblies 54 and also includes a removable handle for use in transporting the golf training device from location to location. As shown in the back inward view of FIG. 2 and in FIG. 3, the wheel assemblies 54 include wheels 88 mounted on rotatable hinge members 90 that allow for their rotation up and out of the way when the golf training device is in use. When it is desired to move the golf training device, the wheels can be swung down into place as shown along curves 92 (in FIG. 2), and a retaining member 94 mounted on the frame 42 with a bolt and nut assembly 96 can be rotated over the hinge member 90 upon which the wheel 88 is mounted in order to keep the wheel 88 in fixed position during transportation of the golf training device. Further, the nut and bolt assembly 96 used to mount the retaining member 94 on the frame 42 can be tightened to increase the force on the retaining member 94 so that the retaining member 94, and therefore wheel 88 does not move from its position during transportation of the golf training device.

The removable handle 86 is an upward-angled steel tube, one end of which is attached to the frame of the golf training device using a suitable receptacle 98. On the other end of the tube is a grip member 100 used in raising the front of the golf training device for transporting the golf training device from location to location, and/or for loading the golf training device onto a trailer (not shown).

Figure 4:
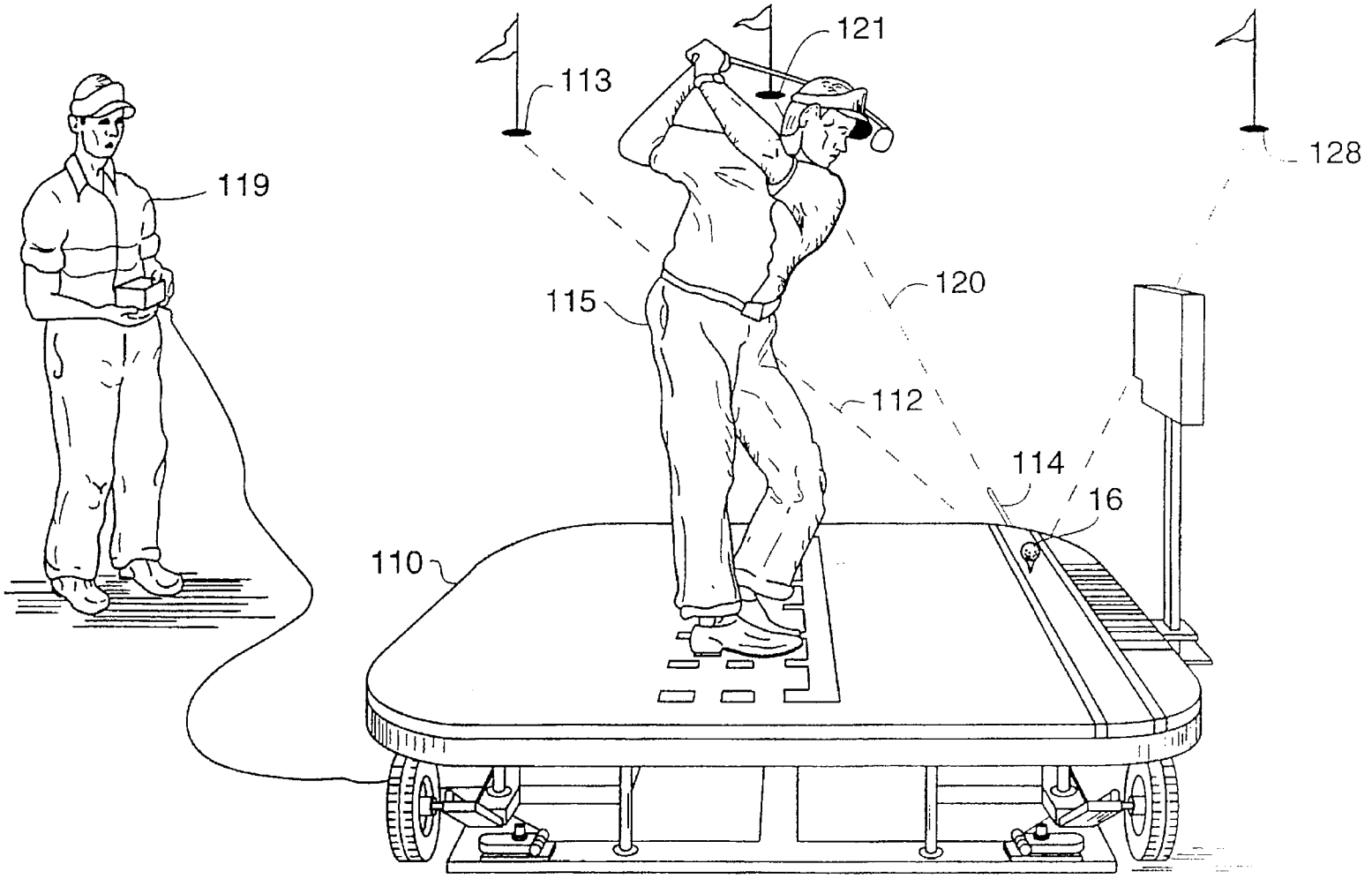
FIG. 4 is a perspective, rear-view of a golfer and golf teaching professional utilizing one embodiment of the golf training device of the present invention.
Figure 5:
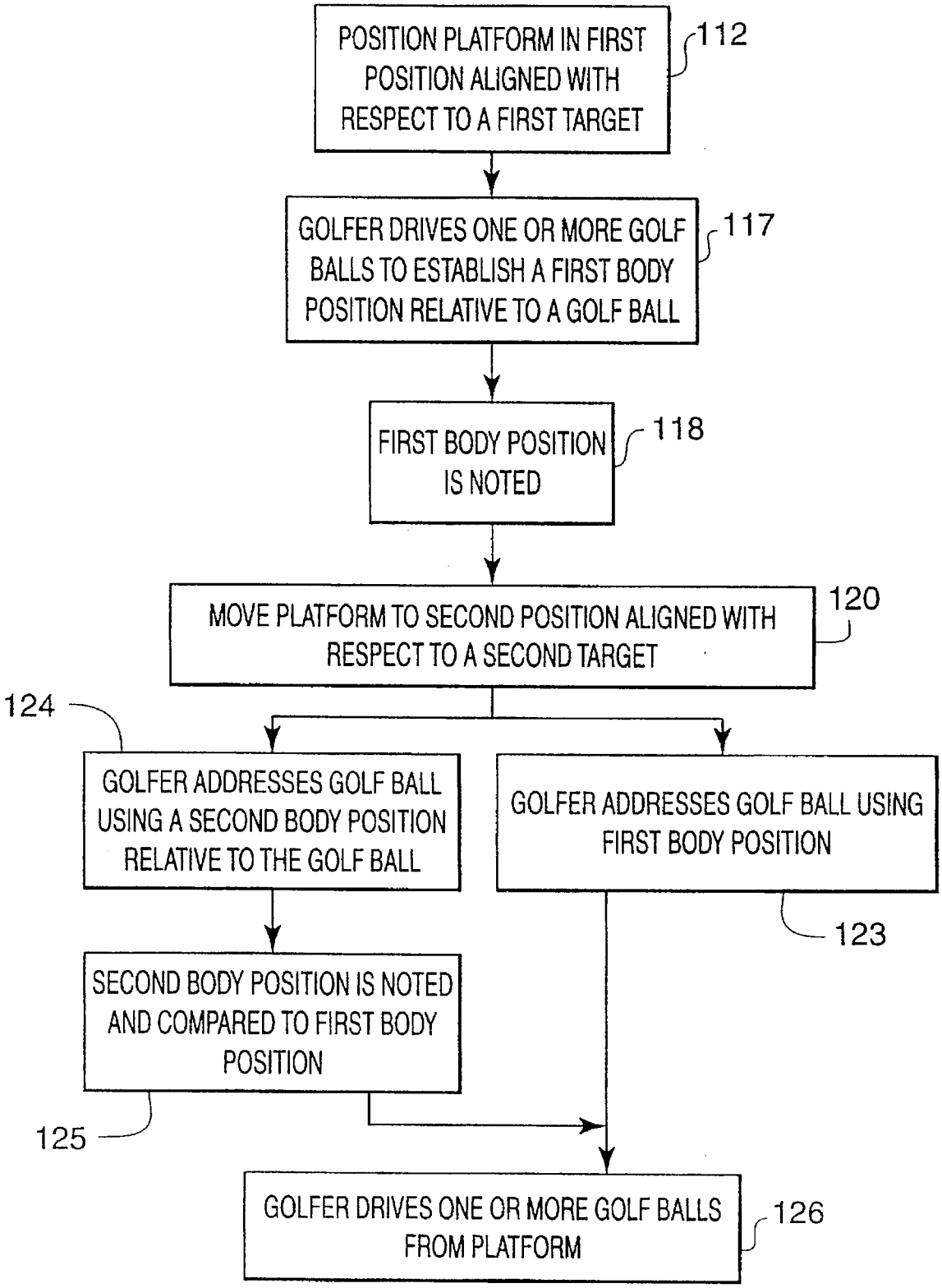
FIG. 5 is a flow diagram of one embodiment of the method of the present invention for training golfers.

The following, with reference to FIGS. 4 and 5, is a description of one embodiment of the methods of the present invention for teaching golfers how to adjust their frame of reference, and ultimately maintain consistent body position with regard to a golf ball in order to drive the golf ball in a variety of different lies toward an intended target. More particularly, FIG. 4 shows integration of the method of the present invention with respect to the golf training apparatus previously described, whereas FIG. 5 is a flow diagram of the method of the present invention and does not specifically relate to the use of the apparatus of the present invention.

With reference to FIGS. 4 and 5, the golf training apparatus 110 is placed in a first position 112, aligned with respect to a desired first target 113 using the target alignment means 114 on the platform. The golfer then positions his or her body 115 and golf ball 116 on the platform and drives one or more balls until a body positioning 117 relative to the golf ball is found wherein the golfer is able to drive the ball acceptably close to, and towards the first intended target 113. After such body and golf ball positioning has been determined, it is either mentally or physically noted 118 by the golfer 115 and/or golf training professional 119.

The platform can then be rotated to a second position 120 angular to the first position and aligned with respect to a second selected target 121. The golfer can then align their body position consistent with that relative to the ball for the first target 123. Alternatively, the golfer can set their body 115 relative to the ball 116 and the target 121 in a position 124 that the golfer feels is correct for reaching the target 121 with the golf ball, and the golfer can then make a comparison of their current body position relative to the noted body position previously obtained for the previous target 113.

In either case, the golfer is allowed to make drives toward the second target 121 to determine how the same (or different) body positions have affected the golfer's swing, and ultimately the travel path of the golf ball towards the intended target. These steps can be repeated numerous times for one or more additional desired targets 128. The awareness of how body position relative to the golf ball, and relative to a target affects the travel path of a driven golf ball, and how body position can be affected by the golfer's frame of reference, is thus learned by the golfer.

The foregoing description of the invention has been presented for purposes of illustration and description. Further, the description is not intended to limit the invention to the form disclosed herein. Consequently, variations and modifications commensurate with the above teachings, and the skill or knowledge in the relevant art are within the scope of the present invention. The embodiment described herein above is further intended to explain modes for practicing the invention and to enable others skilled in the art to utilize the invention in various embodiments and with various modifications required by their particular applications or uses of the invention. It is intended that the appended claims be construed to include alternate embodiments to the extent permitted by the prior art.

What is claimed is:

1. A training apparatus for golfers comprising:

a base and a platform rotatably mounted on said base for supporting a golfer on a top surface of the platform, wherein said platform is rotatably positionable in a plurality of different, rotational orientations relative to said base;

target alignment means disposed on said platform for visual use in aligning said platform with respect to a desired target of said golfer; and golfer positioning means disposed on said top sur-face of said platform for use in determining the position of said golfer relative to a golf ball on the top surface of said platform, wherein the golfer positioning means is positioned the same relative to the top surface of the platform in each of said rotational orientations.

2. The apparatus as claimed in claim 1, wherein said platform comprises a mat which simulates a natural grass fairway.

3. The apparatus as claimed in claim 1, wherein said target alignment means comprise one or more markings on said platform which define one or more straight lines on said platform.

4. The apparatus as claimed in claim 1, wherein said target alignment means comprise an apparatus having at least one component which extends from the surface of said platform for use in aligning said platform with respect to a desired target of said golfer.

5. The apparatus as claimed in claim 4, wherein said aligning device comprises a rod selectively extendable from said platform.

6. The apparatus as claimed in claim 1, wherein said golfer positioning means comprise one or more markings in rows and columns on a portion of said platform where said golfer is locatable in order to address a golf ball on said platform.

7. The apparatus as claimed in claim 6, wherein said golfer positioning means comprise a plurality of markings on a portion of said platform where said golf ball is locatable, arranged in a row parallel to at least one of said rows or columns of markings on a portion of the platform where said golfer is locatable in order to address said golf ball.

8. The apparatus as claimed in claim 1, wherein said base comprises one or more bearing members having one portion affixed to said base and a second portion in contact with a bearing surface on said platform.

9. The apparatus as claimed in claim 1, wherein the top surface of said platform maintains a parallel orientation relative to the base in each of said plurality of rotational orientations.

10. The apparatus as claimed in claim 1, wherein said base comprises a drive assembly and means for controlling said drive assembly.

11. The apparatus as claimed in claim 10, wherein said drive assembly comprises an electric motor and said means for controlling said drive assembly comprise an electric switch.

12. An apparatus for training golfers to maintain consistent body positioning with respect to a golf ball and a target under different frames of reference, comprising:

a base and a platform rotatably affixed to said base for supporting a golfer and golf ball thereupon, wherein said platform is rotatably positionable in a plurality of different, rotational orientations relative to said platform; and golfer positioning means for use in determining the position of said golfer relative to said golf ball and relative to said target, including a first plurality of markings on a first portion of said platform where said golf ball is locatable and a second plurality of markings on a second portion of said platform where said golfer is locatable, wherein the golfer positioning means is positioned the same relative to the platform in each of said plurality of rotational orientations.

13. The apparatus as claimed in claim 12, wherein said second plurality of markings are arranged in a plurality of rows and columns.

14. The apparatus as claimed in claim 13, wherein said first plurality of markings are arranged in a row parallel to at least one of said rows or columns of said second plurality of markings.

15. The apparatus as claimed in claim 12, wherein said platform comprises a target alignment means for visual use in aligning said platform with respect to said target.

16. The apparatus as claimed in claim 15, wherein said target alignment means comprise an apparatus having at least one component which extends from the surface of said platform for use in aligning said platform with respect to a desired target of said golfer.

17. The apparatus as claimed in claim 12, wherein said base comprises one or more bearing members having one portion affixed to said base and a second portion in contact with a bearing surface on said platform.

18. The apparatus as claimed in claim 12, wherein said base comprises a drive assembly and means for controlling said drive assembly.

19. A method for training a golfer to maintain consistent body positioning with respect to a golf ball and a target under different frames of reference, the method comprising the steps of:

providing a platform, rotatably mounted on a base, comprising golfer positioning means on a top surface of the platform for determining the position of said golfer relative to a golf ball on said top surface of the platform;

placing the platform in a first rotational position relative to the base, wherein said platform is aligned with respect to a first target;

hitting at least one golf ball from said platform in said first rotational position;

rotating said platform relative to said base to a second rotational position wherein said platform is aligned with respect to a second target, and wherein the golfer positioning means is positioned the same relative to the top surface of the platform in each of said first and second rotational positions; and hitting at least one golf ball from said platform in said second rotational position.

20. The method as claimed in claim 19, comprising the further steps of:

noting the position of said golfer relative to said ball when said platform is in said first position;

noting the position of said golfer relative to said ball when said platform is in said second position; and comparing the noted positions of said golfer relative to said ball when said platform is in said first and second positions.

21. The apparatus as claimed in claim 12, wherein two or more of said first plurality of markings are arranged in a first row and two or more of said second plurality of markings are arranged in a second row parallel to said first row.

22. An apparatus for training golfers to maintain consistent body positioning with respect to a golf ball and a target in different frames of reference comprising:

a base and a platform rotatably mounted on said base for supporting a golfer on a top surface of the platform, wherein said platform is rotatably positionable in a plurality of different, rotational orientations relative to said platform, and wherein the top surface of said platform maintains a parallel orientation relative to the base in each of said rotational orientations; and golfer positioning means for use in determining the position of said golfer relative to said golf ball, including a first plurality of markings arranged in a first row on a first portion of said platform where said golf ball is locatable and a second plurality of markings arranged in a second row, parallel to said first row, on a second portion of said platform where said golfer is locatable, wherein said golfer positioning means is positioned the same relative to the platform in each of said plurality of rotational orientations.

* * * * *